US007059806B2

(12) United States Patent
Trangsrud

(10) Patent No.: US 7,059,806 B2
(45) Date of Patent: Jun. 13, 2006

(54) HOLE FORMER FOR AN INVERT

(76) Inventor: Julian P. Trangsrud, 300 Cherry St., Northfield, MN (US) 55079

( * ) Notice: Subject to any disclaimer, the term of this patent is extended or adjusted under 35 U.S.C. 154(b) by 0 days.

(21) Appl. No.: 10/646,879

(22) Filed: Aug. 21, 2003

(65) Prior Publication Data

US 2005/0040313 A1 Feb. 24, 2005

(51) Int. Cl.
*E02D 29/12* (2006.01)

(52) U.S. Cl. ..... 405/155; 249/11; 249/160

(58) Field of Classification Search ..... 249/10, 249/11, 144, 160, 165; 405/155
See application file for complete search history.

(56) References Cited

U.S. PATENT DOCUMENTS

| | | | | |
|---|---|---|---|---|
| 3,363,876 | A * | 1/1968 | Moore | 249/145 |
| 3,727,876 | A * | 4/1973 | Keyser | 249/184 |
| 4,422,994 | A * | 12/1983 | Ditcher | 264/219 |
| 4,565,347 | A * | 1/1986 | Ditcher | 249/83 |
| 4,941,643 | A * | 7/1990 | Ditcher | 249/145 |
| 5,381,995 | A | 1/1995 | Del Zotto | 249/35 |
| 5,413,307 | A | 5/1995 | Tidwell | 249/11 |
| 5,806,829 | A * | 9/1998 | Banks | 249/11 |
| 6,110,402 | A | 8/2000 | Miller | 264/31 |
| 6,226,928 | B1 * | 5/2001 | Trangsrud | 52/20 |
| 6,347,781 | B1 | 2/2002 | Trangsrud | 249/11 |
| 6,651,949 | B1 * | 11/2003 | Westhoff et al. | 249/63 |

* cited by examiner

*Primary Examiner*—John Kreck
(74) *Attorney, Agent, or Firm*—Nikolai & Mersereau, P.A.

(57) ABSTRACT

A hole former for a manhole with an invert, which aligns the hole with the invert such that pipes are properly aligned and will not leak or cause damming when connected to the manhole. The hole former has an alignment member with a central aperture as a part of the hole former or a separate part. The alignment member has a central cylindrical male portion, which fits into a central cylindrical female portion of the hole former to align the hole former and the alignment member. The invert has a tube on the central axis of its pipe portion. A straight bar inserted in the central axis of the alignment member and the tube in the invert aligns the hole former with the invert. When cement is poured over the hole former, the hole formed will be properly aligned to allow a pipe to be connected to the manhole.

4 Claims, 7 Drawing Sheets

HOLE FORMER FOR AN INVERT

BACKGROUND OF THE INVENTION

1. Field of the Invention

This invention relates to hole formers for use in fabricating concrete and more particularly for forming a hole aligned with a connecting pipe for a manhole invert.

2. Description of the Related Art

Forming holes in concrete manhole walls by use of a hollow cylinder section in a concrete mold is a preferred way of making concrete manholes. However the hollow cylinder sections are difficult to align with the manhole such that the hole left in the manhole wall will be aligned with an internal invert to provide a good pipe connection. If the pipe is not properly aligned with the internal invert, leaks may result. Further, misalignments with the manhole invert may cause damming at the intersection of the invert pipe and the manhole invert, restricting the flow therein.

Prior art hole formers have had bolts around the perimeter of the hole for attaching the hole former to the mold which makes it difficult to install and remove the hole former. Further, the hole formers did not use attachments to make the hole formers universally adaptable to different manhole molds.

SUMMARY OF THE INVENTION

The hole former for an invert aligns a hole in a manhole wall with an invert such that pipe connections to the invert can be made squarely to insure the connection will not leak due to misalignment of the pipe with the invert and further to eliminate damming where the height of the invert or the pipe are at different levels causing a backup of fluids at the interface.

The apparatus includes a hole former which is aligned with the invert by a bar passing through a central aperture in an alignment member inserted into the hole former and a central tube in the invert to align the hole former with the invert.

In embodiments where there is a gap between the hole former and the invert a spacer portion is added to the alignment member to fill in the gap and help align the hole former with the invert.

Different spacer portions may be used to allow the hole former to be used in multiple applications with different molds and for different designs of manholes. In some embodiments the spacer will not be needed since the hole former and the invert will form the hole without the aid of a spacer.

OBJECTS OF THE INVENTION

It is an object of the invention to provide a hole former which is easy to install and easy to remove from a molded concrete manhole.

It is an object of the invention to provide a hole former which will provide for alignment of pipes to the invert of the manhole.

It is an object of the invention to eliminate leaks due to misaligned pipes connected to a manhole.

It is an object of the invention to eliminate damming caused by misaligned connections of pipes to the invert.

It is an object of the invention to use one hole former combined with various alignment members and alignment members with spacers to form the correctly sized and aligned holes in the manholes.

Other objects, advantages and novel features of the present invention will become apparent from the following description of the preferred embodiments when considered in conjunction with the accompanying drawings.

DESCRIPTION OF THE PREFERRED EMBODIMENTS

Concrete inverts are molded by use of an outer mold wall and an inner mold wall with a table thereon. When concrete fills the mold it forms the wall of the invert between the inner and outer mold walls, and forms the base of the invert, having a trough and a flange portion for engaging the flange of a connecting pipe by concrete poured on top of the table. After the concrete invert is formed the mold is removed and the invert, which is molded up side down, is turned over and is ready for use.

Problems with molding the inverts occur when the hole in the side of the invert is not properly aligned for mating with a connecting pipe. The misalignment can result in leaks when pipes do not meet squarely with the invert. The misalignment may also cause damming, which backs up water or limits flows, if the inside diameters of the invert hole and the connecting pipe are misaligned and therefore not at the same height.

Figure 5:
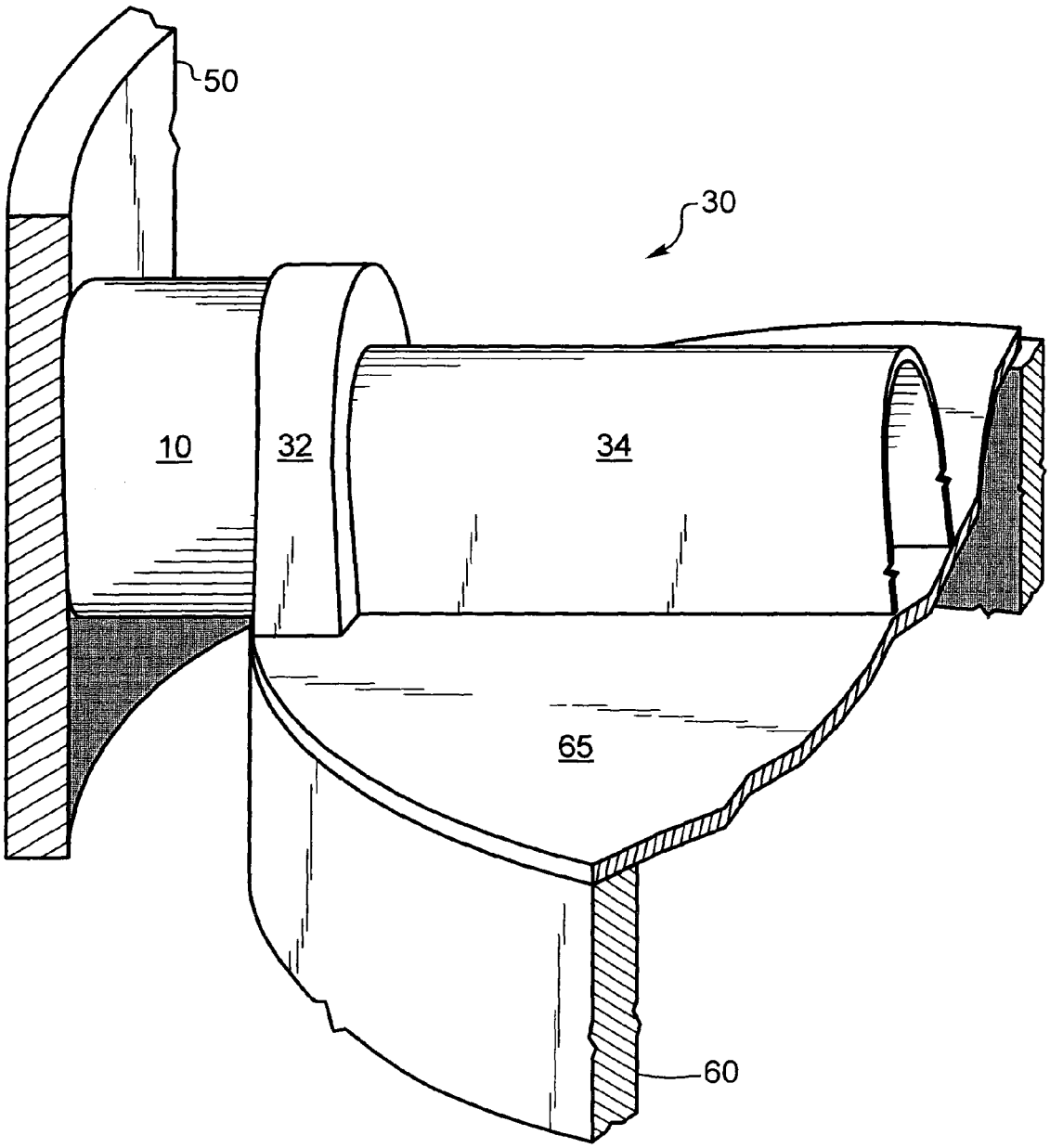
FIG. 5 is a side perspective of the assembled hole former with an alignment member and invert mold.
Figure 9:
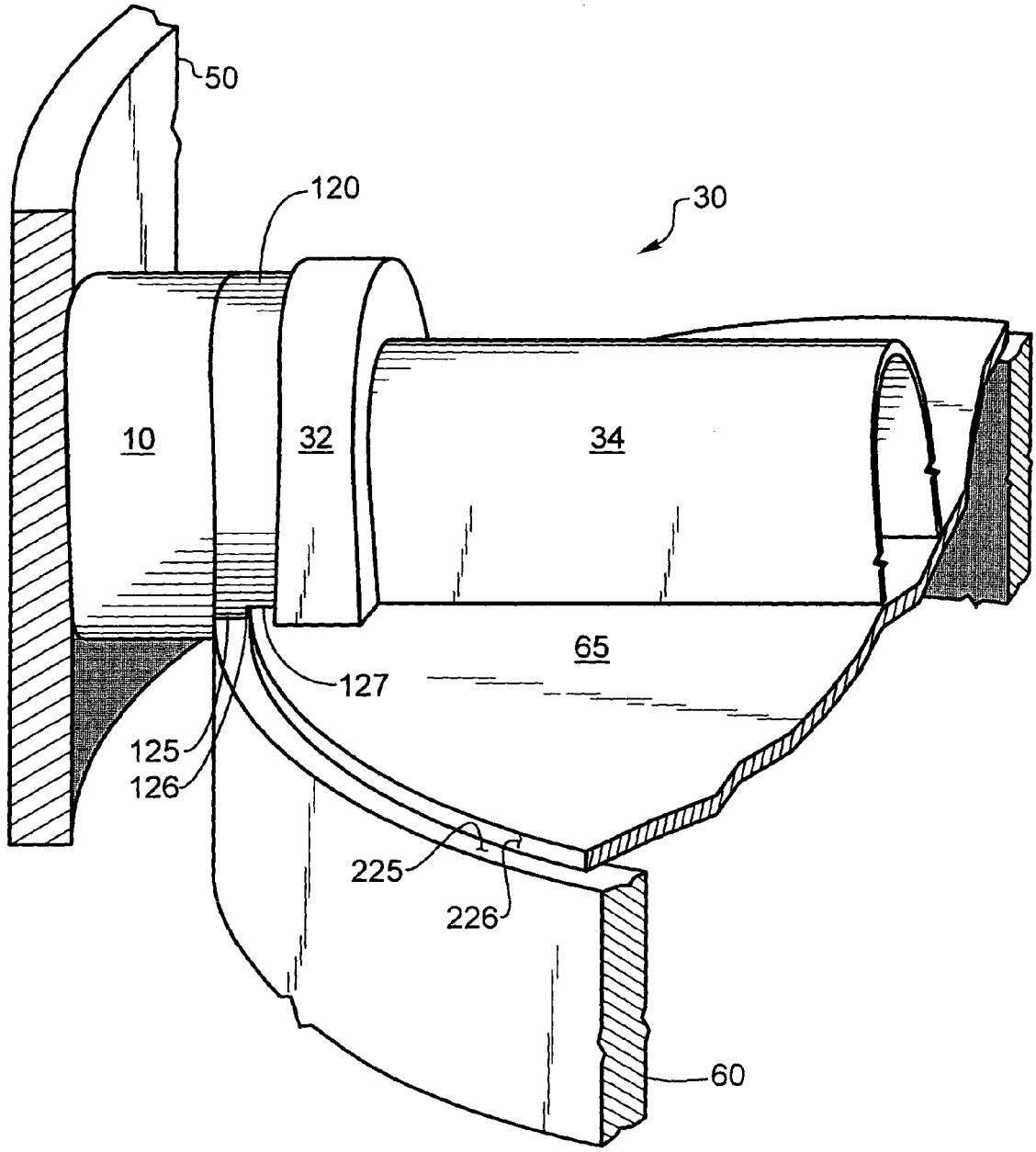
FIG. 9 is a side perspective of the assembled hole former with an alignment member with a spacer section and invert mold.

Many types of invert molds are currently in use. As shown in FIG. 5 a mold pipe 60 and the tabletop 65 have the same diameter and the hole former 10 connects to the invert mold 30 on the tabletop 65 to form the invert mold. As shown in FIG. 9 the tabletop 65 may not have the same diameter as the mold pipe 60. When a table 65 is placed on the top of the mold pipe 60 and the circumference of the table top 65 is not the same as the mold pipe 60 there can be an outside circumference ring 225, a vertical wall or slope 226, and a top surface of the table 65 which must be encountered by a spacer portion 124 extending out from hole former 10. The spacer portion 124 of alignment member 120 is used in conjunction with the hole former 10 to bridge the step and help align the hole former 10 with the invert mold 30.

There can be several kinds of tabletops 65, some with several layers of materials and several steps at the circumference. Some tabletops may have sloped walls 226 at the circumference. The spacer portions 124 are designed to bridge the gap between the hole former 10 and the invert mold 30. The spacer portions 124 are specially designed for the steps or slopes encountered at the mold pipe 60-tabletop 65 interface. As shown in FIG. 9 there is a step or vertical wall 226 between the top of mold pipe 60 and the of tabletop 65 such that the spacer portion 124 has outer ring 125 mating with circumference ring 225 on top mold pipe 60 and an inner ring 127 mating with the top of table 65 with a step 126 on spacer portion 124 matching the step 226 on the side of the tabletop 65.

As shown in FIGS. 1–5 a hole former 10 and an alignment member 20 are used in conjunction with an invert mold 30 to easily and accurately form a properly aligned hole in a manhole for a pipe to connect to an invert.

The invert mold 30 provides the inner part of the mold. It has a pipe wall 60, a tabletop 65 resting on the top of the pipe wall 60, an invert pipe mold portion 34 on top of the tabletop 65 and a flange mold 32 at the ends of the pipe mold portion 34 near the circumference of the invert. A mold wall 50 provides the outside wall of the mold. Concrete is poured into the mold between pipe wall 60 and mold wall 50 and then up to the top of the mold such that the concrete covers the hole former 10 and invert mold 30. When the molded invert is removed from the mold, the hole former 10 and alignment member 20 therein are easily removed form the side of the freshly molded invert and the invert mold 30 is then removed from the top of the invert before or after it is turned right side up.

When assembling the whole former 10 and the invert mold 30 to get it ready for pouring concrete in the mold, the hole former 10 is properly aligned with the manhole by use of an alignment member 20. The alignment member 20 has a flat top end 21 and a tapered outside wall 22. The tapered wall 22 of the alignment member 20 engages the tapered inside wall 13 of the hole former 10 to align the hole former 10 on the alignment member 20. The top 21 of the alignment member 20 engages the flange shoulder 14 on the hole former 10 to hold the hole former 10 in the desired location. Further, the base 12 of the hole former 10 and the base 28 of the alignment member 20 are preferably coplanar and rest on the face 36 of invert mold 30.

The alignment member 20 has a cylindrical aperture 29 though its central axis and the invert 30 has a cylindrical aperture 35 in its front face 36 and a tube 37 attached to a plate 39 inside the invert mold 30 at one end and held in place by an aperture 42 in block 38 at the other end, to center the tube 37 along the central axis of the invert pipe 34.

When properly aligned the hole former 10 rests on the top of the tabletop 65 and the end of 12 of the hole former 10 and the end 28 of the alignment member 20 are adjacent the face 36 of the invert mold 30 and the tube 37 on the central axis of pipe 34 is aligned with the aperture 29 in alignment member 20.

Figure 1:
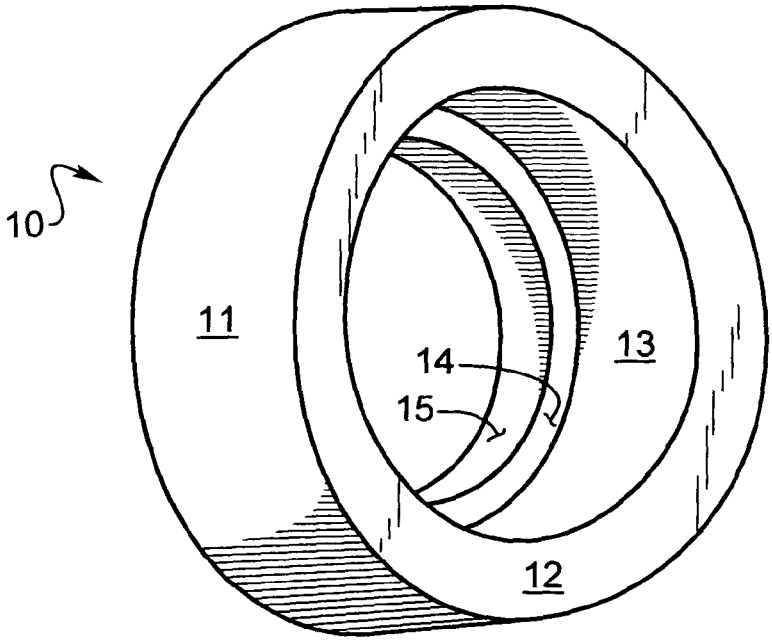
FIG. 1 is a perspective view of a hole former.
Figure 2:
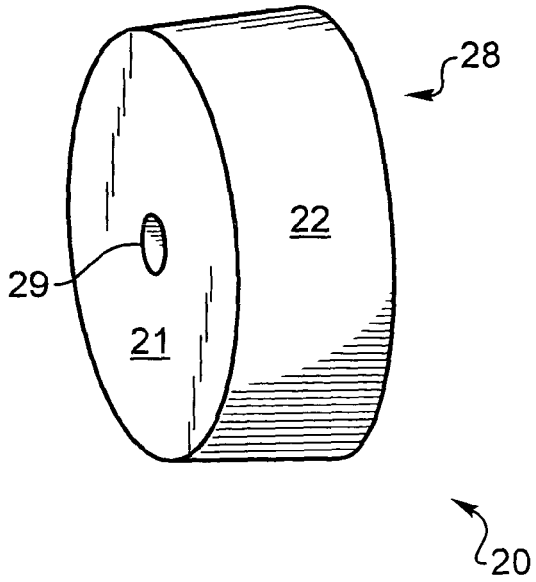
FIG. 2 is a perspective view of an alignment member for the hole former.
Figure 3:
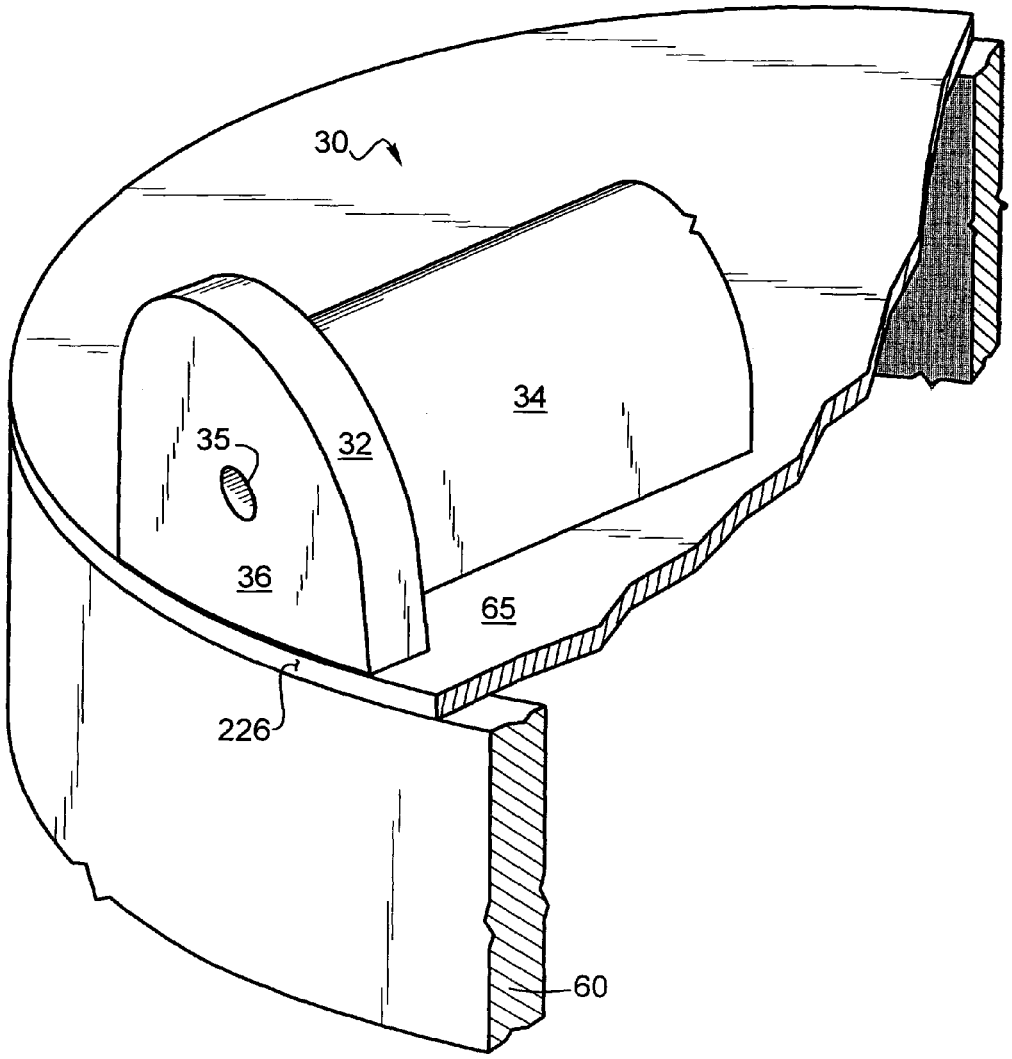
FIG. 3 is a perspective view of the invert mold with the tabletop aligned with the mold pipe.
Figure 4:
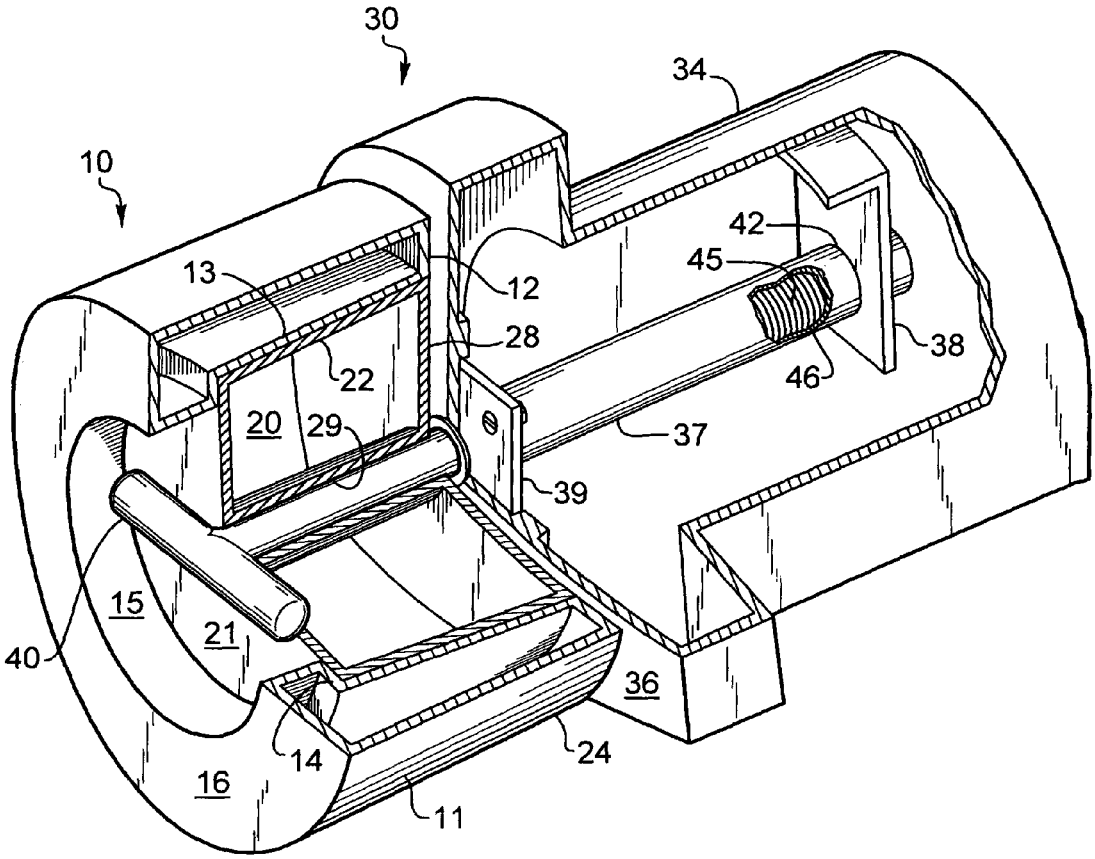
FIG. 4 is a cut away perspective of the assembled hole former, alignment member and invert mold.

A straight portion of T-bar 40 when inserted through the cylindrical aperture 29 and tube 37 fixes alignment member 20 and therefore the hole former 10 in alignment with the invert mold 30 such that a hole is formed in the manhole, which is aligned with the aperture of the invert pipe 34 in invert mold 30. Therefore when a pipe is connected to the manhole it is aligned with the invert pipe and can be properly connected with a flush fit to avoid leaks and damming at the connection point. As shown in FIG. 4 the T bar 40 has threads 45, which engage threads 46 in tube 37 to tighten the hole former to the invert mold 30 to insure proper alignment. The T bar 40 may have a collar or other means for engaging the face 21 of the alignment member 20 to help tighten it against the face 36 of the invert mold 30. The handle on the T-bar 40 may be a D shape or some other shape other than a T to aid in pulling the bar 40 out of the hole former 10, alignment member 20 and invert 30.

The handle of the T-bar 40 is recessed into the spacer 10 by flange 15 on hole former 10, when the front end 16 is against the mold wall 50. This allows the concrete to be poured over the hole former 10 without the T-bar 40 being subject to being set in concrete and allows for the ease of withdrawing the T-bar 40 from the hole former 10.

After the hole former 10, alignment member 20 and invert mold 30 are assembled cement is poured filling the mold to form a manhole. While the cement is green The mold wall 50 is removed, the T-bar 40 is withdrawn, by pulling on the T portion of the bar 40, allowing the hole former 10 and the alignment member 20 to be removed from the setting concrete. The table top 65 containing the invert mold 30, and the mold pipe 60 are removed leaving a manhole with an invert. A pipe can be connected to the invert with confidence that the pipe will be aligned with and fit with the invert such that there will no leaks or damming due to misalignments.

In an alternate embodiment the hole former 10 and the alignment member 20 may be integrated into one part.

As shown in FIGS. 6–9 a hole former 10 has an alignment member 120 with a spacer portion 124 used in conjunction with an invert mold 30 to easily and accurately form a properly aligned hole in a manhole for a pipe to connect to an invert where a discontinuity would otherwise exist between the hole former 10 and the invert mold 30. For example in some molding operations the tabletop 65 may have a smaller diameter than the supporting mold pipe 60, leaving an outer ring 225 and a step 226. In other manhole molds the mold wall 50 and mold pipe 60 may be spaced closer together or further apart to adjust the wall thickness of the manhole, which will require different length spacer portions 124 on alignment member 120. By providing different spacers portions 124 on alignment member 120 a large variety of molds can be accommodated with the same hole former 10.

Figure 6:
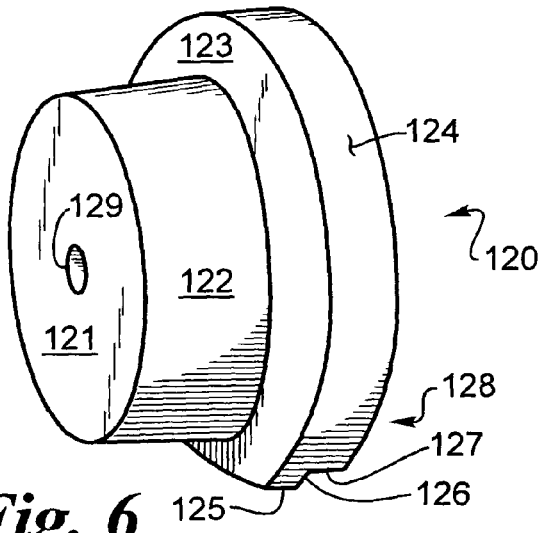
FIG. 6 is a perspective view of the alignment member with a spacer section.
Figure 7:
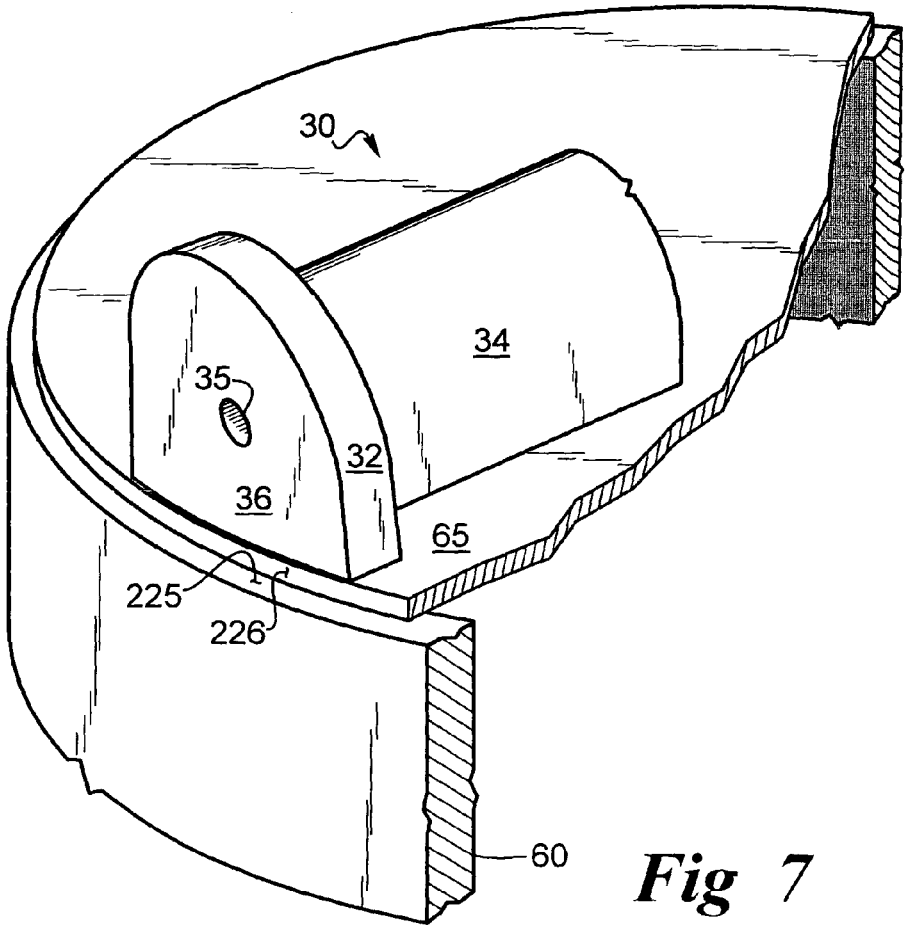
FIG. 7 is a perspective view of the invert mold with the tabletop offset from the mold pipe.
Figure 8:
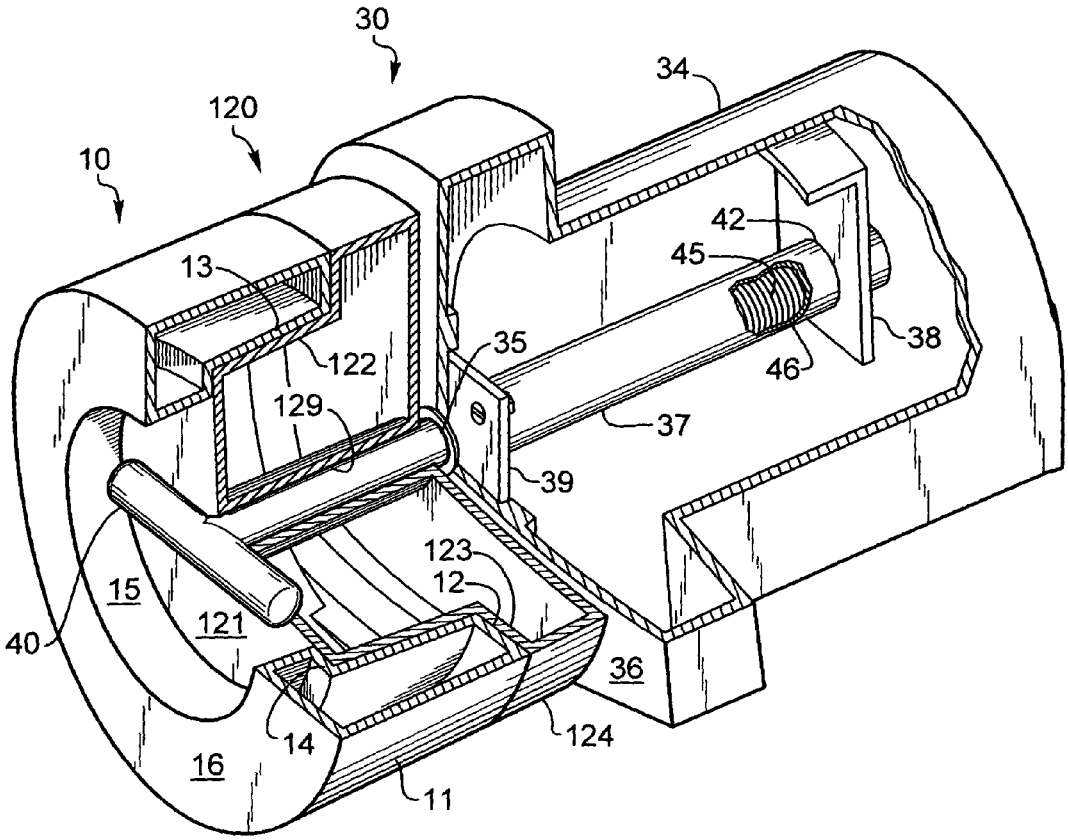
FIG. 8 is a cut away perspective of the assembled hole former, alignment member with a spacer section and an invert mold.

FIG. 6 shows an alignment member 120 with a flat top end 121 and a tapered outside wall 122. The tapered wall 122 of the alignment member 120 engages the tapered inside wall 13 of the hole former 10 to align the hole former 10 on the alignment member 120. The top 121 of the alignment member 120 engages the flange shoulder 14 on the hole former 10 to hold the hole former 10 in the desired location. Further, the base 12 of the hole former 10 and the top of the base 123 of the alignment member 120 engage to define the length of the hole made by the lengths of the hole former 10 and the spacer portion 124 of the alignment member 120. The bottom of the base 128 of the spacer portion 124 of alignment member 120 rests on the face 36 of the of invert mold 30. The outer ring 125 of the spacer portion 124 on the alignment member 120 rests on the outer ring 225 formed on the top of the mold pipe 60 and the wall portion 126 of the spacer portion 124 rests against the wall portion 226 of the tabletop 65 and the inner ring 127 of the spacer portion 124 rests on the top of the tabletop 65. In this manner all gaps are filled in the mold and the spacer portion 124 outer ring 125, inner ring 127 and wall portion 126 help align the alignment member 120 with the invert mold 30 for a better fitting hole in the invert wall such that the pipes are better aligned with the invert. The outer wall 11 of the hole former 10 and the outer wall of the spacer 124 are of the same diameter to form a continuous uniform diameter hole in the manhole.

As before a straight portion of T-bar 40 when inserted through the cylindrical aperture 129 in alignment member 120 and tube 37 aligns the alignment member 120 and therefore the hole former 10 with the invert mold 30 such that a hole is formed in the manhole, which is aligned with the aperture of the invert pipe 34 in invert mold 30. Therefore when a pipe is connected to the manhole it is aligned with the invert pipe and can be properly connected with a flush fit to avoid leaks and damming at the connection point.

In an alternate embodiment the hole former 10 and the alignment member 120 may be integrated into one part.

In other embodiments different sized holes can be made in the manholes by using different sized outer diameter hole formers 10 in conjunction with the alignment members 20 or alignment members 120 with spacer portions 124.

Obviously, many modifications and variations of the present invention are possible in light of the above teachings. It is therefore to be understood that, within the scope of the appended claims, the invention may be practiced otherwise than as specifically described.

What is claimed is:

1. A hole former for a manhole with an invert comprising:

a hole former having an outside diameter wall, a first inside diameter wall with a length substantially the length of the outside diameter wall and a second inside diameter wall having a smaller diameter than the first diameter and forming a shoulder inside the hole former where the first and second inside diameter walls meet, an alignment member with an aperture along the length of the central axis through the alignment member, the alignment member having an outside diameter wall, a front wall and a rear wall, the outside diameter wall of the alignment member nests snuggly inside the hole former first inside diameter wall along its entire length with the front wall engaging the shoulder on the inside of the hole former, an invert mold having an outside wall for engaging the rear wall of the alignment member, the invert mold having an invert pipe portion with a tube aligned on the central axis of the invert pipe portion, the tube extending through a portion of the invert pipe portion a distance such that when the central axis through the alignment member is aligned with the tube in the invert mold a desirably aligned hole in the manhole results for making pipe connections thereto, a bar for inserting in the aperture of the alignment member and the invert mold tube for aligning the hole former with the invert mold.

2. A hole former for a manhole with an invert as in claim 1 wherein, the alignment member and hole former are integral.

3. A hole former for a manhole with an invert as in claim 1 wherein, a threaded portion of the bar engages a threaded portion of the tube to secure the hole former to the invert mold.

4. A hole former for a manhole with an invert as in claim 1 wherein, the alignment member has a spacer portion for displacing the hole former from the invert mold pipe portion and mating therewith.

* * * * *